United States Patent [19]

Michel

[11] 3,962,947

[45] June 15, 1976

[54] SOUND PRODUCING APPARATUS

[76] Inventor: Adolf Michel, Ulrichs-Au 1, D-8124 Seeshaupt, Germany

[22] Filed: Feb. 21, 1975

[21] Appl. No.: 551,829

Related U.S. Application Data

[63] Continuation of Ser. No. 381,554, July 23, 1973, abandoned, which is a continuation of Ser. No. 191,767, Oct. 22, 1971, abandoned.

[30] Foreign Application Priority Data

| | | |
|---|---|---|
| Oct. 26, 1970 | Germany | 2052463 |
| Feb. 27, 1971 | Germany | 2109438 |
| Aug. 16, 1971 | Germany | 2140933 |

[52] U.S. Cl. ..... 84/1.24; 84/1.25

[51] Int. Cl.[2] ..... G10H 1/04; G10H 5/06

[58] Field of Search ..... 84/1.01, 1.24, 1.25, 84/DIG. 4

[56] References Cited

UNITED STATES PATENTS

| | | | |
|---|---|---|---|
| 3,004,460 | 10/1961 | Wayne, Jr. | 84/1.01 |
| 3,147,333 | 9/1964 | Wayne, Jr. | 84/1.24 |
| 3,418,418 | 12/1968 | Wilder | 84/1.25 |
| 3,524,376 | 8/1970 | Heytow | 84/1.25 |
| 3,609,204 | 9/1971 | Peterson | 84/1.25 |
| 3,609,205 | 9/1971 | Schwartz et al. | 84/1.25 |
| 3,624,266 | 11/1971 | Sharp | 84/1.24 |
| 3,626,077 | 12/1971 | Munch, Jr. et al. | 84/1.24 |
| 3,644,657 | 2/1972 | Miller | 84/1.25 |

*Primary Examiner*—L. T. Hix
*Assistant Examiner*—Stanley J. Witkowski
*Attorney, Agent, or Firm*—Donald D. Jeffery

[57] ABSTRACT

A method of and apparatus for increasing the fullness of tone of electronic musical instruments having at least one set of tone generators corresponding to the tonal range of the instrument through the playing of individual registers and/or groups of registers optionally selectible from these tone generators, by one or more key systems. Electric sound oscillations which are provided by the tone generators and optionally combined to form registers are subjected to cyclic phase shifts, the period of the cycle of which is so low that these shifts are not acoustically discernible in the individual sound or register or group of registers.

20 Claims, 11 Drawing Figures

SOUND PRODUCING APPARATUS

CROSS-REFERENCES TO RELATED APPLICATIONS

This is a continuation of application Ser. No. 381,554, filed July 23, 1973, and now abandoned, which is a continuation of application Ser. No. 191,767, filed Oct. 22, 1971, and now abandoned.

FIELD OF THE INVENTION

The invention relates to sound producing apparatus and to a method of controlling the fullness of tone of such apparatus, e.g. electronic musical instruments with at least one set of electric tone generators corresponding to the tonal range of the instrument. Individual registers and/or groups of registers may be selectible from these tone generators and may be adapted to be played by means of one or more key systems.

BACKGROUND OF THE INVENTION

It is well known that the fullness of tone of an instrument, an orchestra or a choir depends upon the number of individual sound elements or voices that are heard at the same time. Thus, for example, ten violins simultaneously playing one and the same note provide a richer tone than one violin which is raised to the same sound level as the ten violins by means of an electro-acoustic amplifying system. The same naturally applies in the case of instruments that are able to emit simultaneously a plurality of sound elements or voices of the same note; a particular example of such an instrument is the organ.

In the building of electronic organs two concepts have been employed, namely that of the synchronous organ and that of the asynchronous organ. All tones of the synchronous organ are produced from twelve master voices corresponding to the twelve semi-tones of the tempered scale. This is effected by division or multiplication of frequency. By reason of exact mathematical dependence of the tones of a register on their particular master voices, all the octave tones are simultaneously identical with the harmonics of the basic tone; this means that, as regards fullness of tone, the entire instrument emits a sound like a register rich in overtones. Unfortunately, it is not possible to increase the richness of tone beyond this. The synchronous organ however offers the considerable advantage of low cost and great pitch constancy.

In the case of the asynchronous organ, however, the individual voices are produced in individual tone generators equivalent to organ pipes. The fullness of tone of organs of this kind can be increased as required by increasing the number of individual generators and by their multiple use. This method is complicated and therefore very costly; furthermore, the cost and difficulty involved in maintenance can be considerably greater for asynchronous organs, particularly in view of the large number of individual tone generators (e.g. 500 as compared with 12 in the case of the synchronous organ).

It is an aim of the invention to provide a method and apparatus in which the fullness of tone of such musical instruments can be increased without the use of complicated, and therefore expensive, equipment.

SUMMARY OF THE INVENTION

According to the invention, and in a method of the initially stated kind, this object is achieved by subjecting the electric sound oscillations, which are provided by the tone generators (generally a synchronous set of notes) and are optionally combined to form registers, to cyclic phase shifts the cycle of which is so low that these shifts are not however acoustically discernible in the individual sound or register or group of registers.

To enable the invention to be understood, mathematical and musical relationships will first be discussed. If a basic oscillation in sound and, for example, its second harmonic are considered, then the two together form only one entity in the musical sense; if however, the two sound oscillations are each produced in separate means for generating individual tones, then (as a consequence of the very slight deviation in frequency in the mathematical sense) two entities are obtained. Such sound oscillations will be referred to hereinafter as individual voices.

Individual elements of a geometrical series (as represented by the semi-tones of the tempered scale), increased or reduced by elements of an arithmetical series (as occur during a modulation), constitute new elements which only stand in a whole-number or rational relationship to each other and to the original individual element of the geometrical series in special cases. Thus, if such an operation is carried out with sound frequencies, new individual frequencies or voices in the above sense occur.

Since, for the purpose of the present invention, the new frequencies should not be acoustically discernible in the individual sounds, i.e. if changes in amplitude are not to occur and changes in frequency are to occur to only a very slight extent, modes of operation available are low frequency phase or frequency modulation alone or with a frequency shift, or a frequency shift alone. The method of the present invention thus comprises a number of variants depending upon which type of cyclic phase shift is used and upon what it is applied to (individual tone, register or work).

As is well known, electronic organs generally have a tone range of 8 octaves, which corresponds to a frequency ratio of 256 between the deepest and the highest tone of the instrument. For this reason, the use of the Doppler effect in present-day electronic organs is generally not possible since a frequency change of for example 0.1 cycle per second in the lowest tone would correspond to an acoustically very unpleasant change in frequency of about 25 cycles in the highest tone. If however it were required to use the Doppler effect for each tone, an extremely complicated technical system would result, since a separate amplifier and a free-moving loud-speaker would have to be provided for each tone. The same technical complication would arise in providing the Doppler effect electrically or electromechanically (tape recorders).

BRIEF DESCRIPTION OF THE DRAWINGS

Illustrative embodiments of the invention will now be particularly described with reference to the accompanying drawings, in which.

DETAILED DESCRIPTION OF THE DRAWINGS

Figure 1:
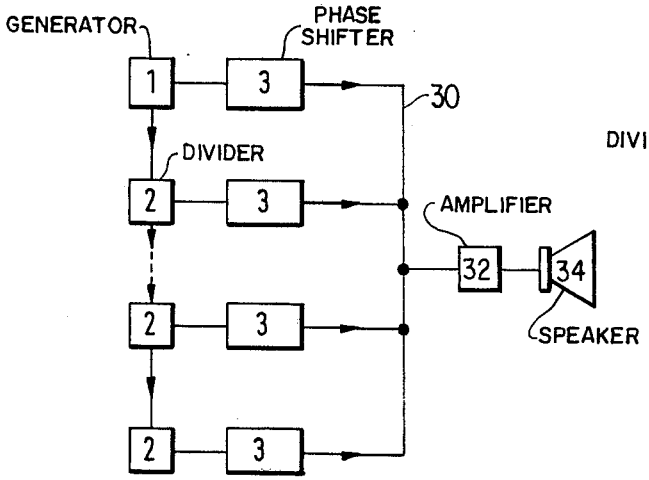
FIGS. 1 to 6 are block diagrams of circuits for producing signals which can be reproduced as sound.

In the interest of clarity, like reference numerals refer to like parts.

Figure 10:
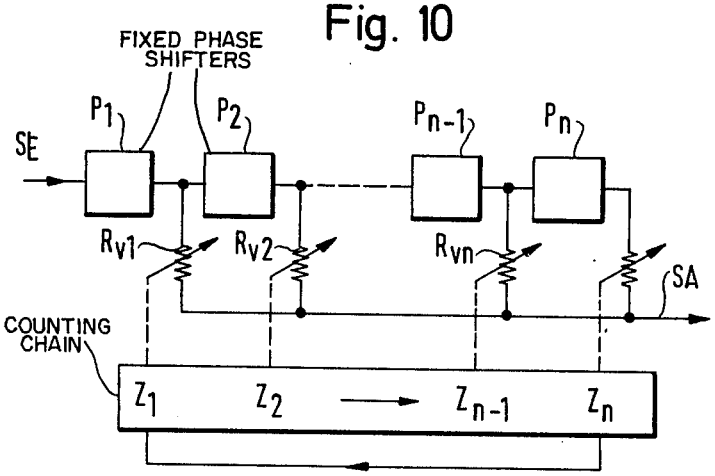
FIGS. 10 and 11 show phase shifting circuits.
Figure 11:
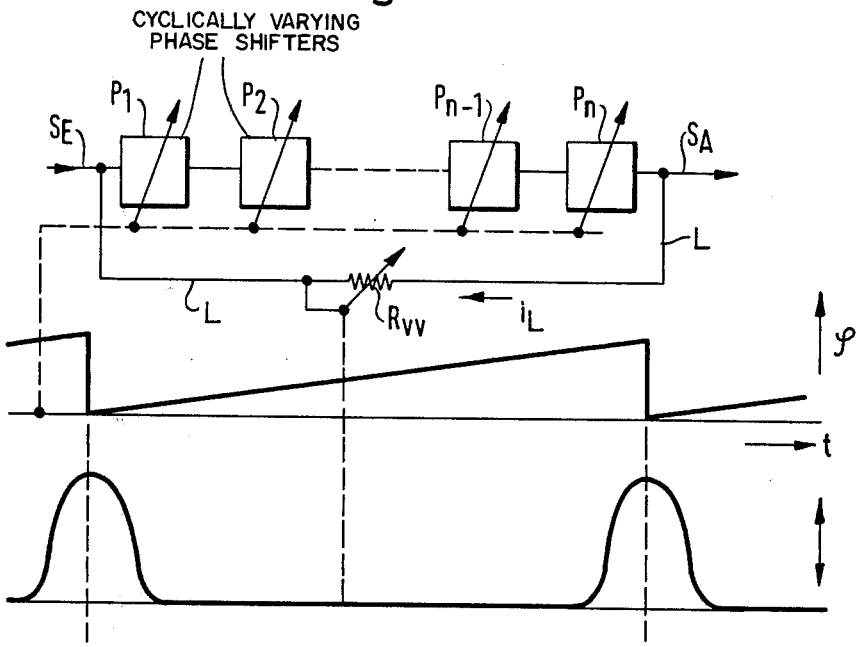

An organ comprises a synchronous set of notes, of which individual sound frequencies are passed by way of corresponding keys to collecting lines, the latter corresponding to the individual registers or groups of registers. In accordance with the invention and in this arrangement, either a phase modulation (the apparatus of FIG. 7 described later is suitable for this) or a frequency shift, (the apparatus of FIG. 10 or FIG. 11 is suitable for this) optionally with additional phase modulation are carried out between the collector lines and the amplifiers at the output ends thereof. In the case of a phase modulation using the apparatus of FIG. 7, the modulation ratio (modulation curve) is virtually independent of the level of sound frequency or of its harmonic; in the case of modulation using the apparatus of FIG. 10 or FIG. 11, this is dependent upon the level of sound frequency and its harmonic.

As illustrated in FIG. 1, the tone production means comprises a synchronised set of notes. This set of notes, for a semi-tone, is illustrated by a generator 1 and frequency dividers (harmonic generators) 2. According to the invention, phase modulation and/or frequency shift are carried out in the tone leads, this being done by connecting apparatus 3, which may be the apparatus of FIGS. 7, 9, 10 or 11 into the circuit.

Figure 2:
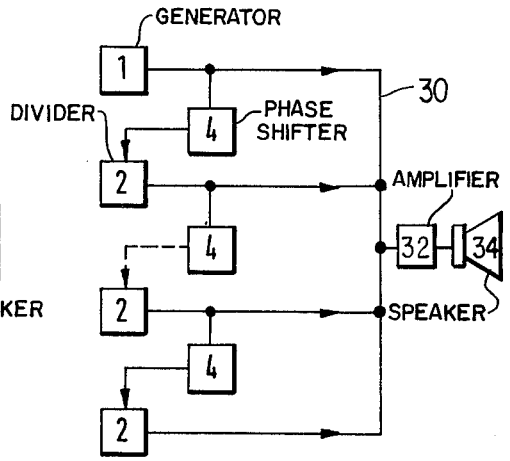

As illustrated in FIG. 2, phase modulations are carried out by apparatus 4 between the tone generator 1 and the first divider 2, as well as between the remaining dividers 2. The apparatus 4 can be the FIG. 9 apparatus, which is particularly suitable for use in this embodiment; the apparatus of FIG. 7 can however also be used.

Figure 3:
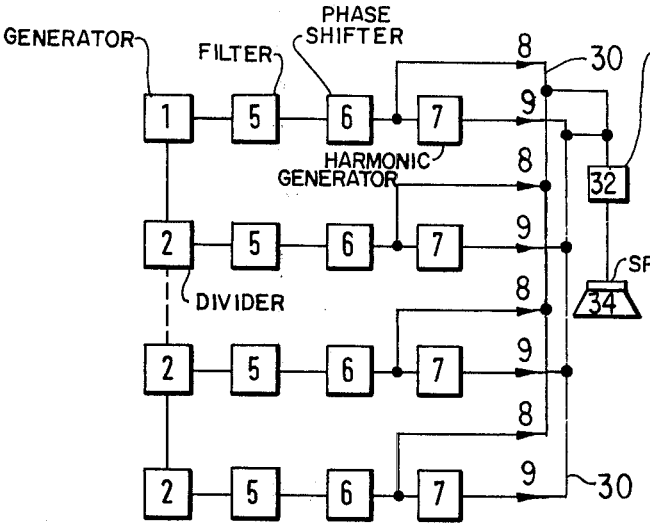
Figure 7:
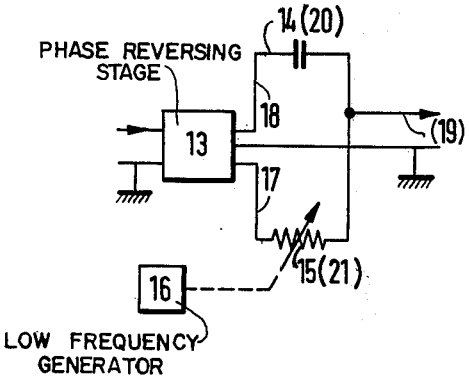
FIG. 7 shows a phase modulating circuit for cyclicly shifting the phase of an input tone signal at a very low rate.
Figure 9:
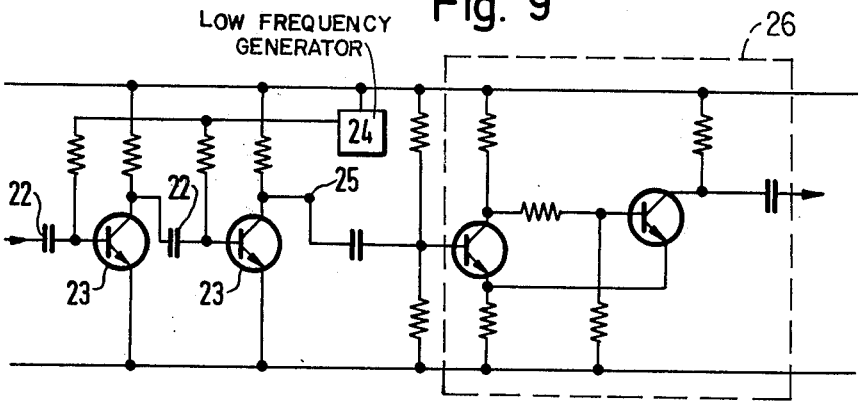
FIG. 9 shows a different form of phase modulating circuit employing transistors as variable resistor devices.

FIG. 3 illustrates an example with outputs 8 low in harmonics (flutes) and outputs 9 rich in harmonics (leading instruments or reeds). The mode of operation is as follows: Filters 5 are connected to the output points of a synchronous chain of dividers (consisting of the generator 1 and the dividers 2) and are used for largely filtering out the harmonics occurring during division. Sinusoidal sound oscillations are thus supplied to the input of each modulator 6 and are cyclically modulated in phase. The modulated signals are then either passed directly to the outputs 8 or, by way of harmonic generators 7, to outputs 9. The apparatus of FIG. 7 or FIG. 9 is preferably used as modulator 6 in this case. The signals to the pairs of outputs 8 and 9 are combined at the outputs and do not surge in relation to each other.

Figure 4:
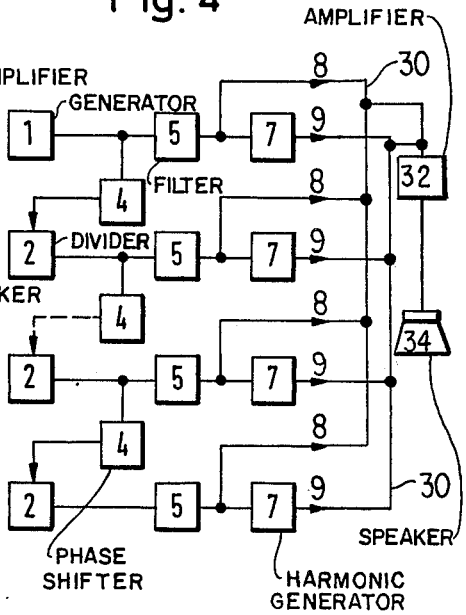

In the embodiment shown in FIG. 4, modulation takes place in the same way as in FIG. 2, and tone colors are separated as in FIG. 3. The apparatus of FIG. 7 or FIG. 9 is preferably used; the outputs 8 and 9 do not surge relative to each other.

Figure 5:
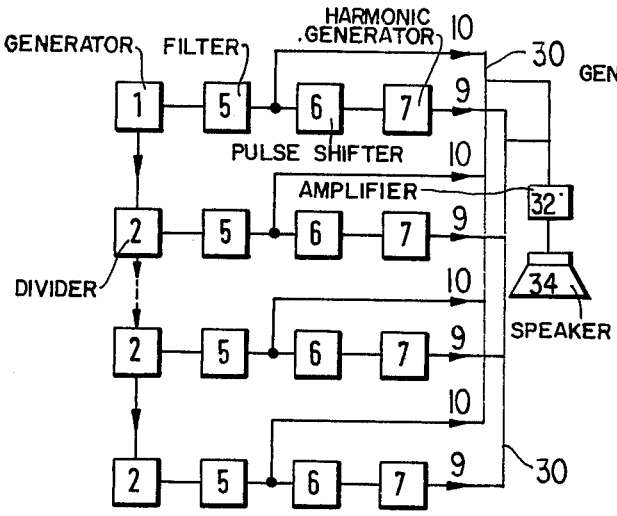

The embodiment of FIG. 5 corresponds substantially to that of FIG. 3 but with the exception that outputs 10 are connected directly to the output side of the filters 5. Thus, the outputs do surge relative to each other.

Figure 6:
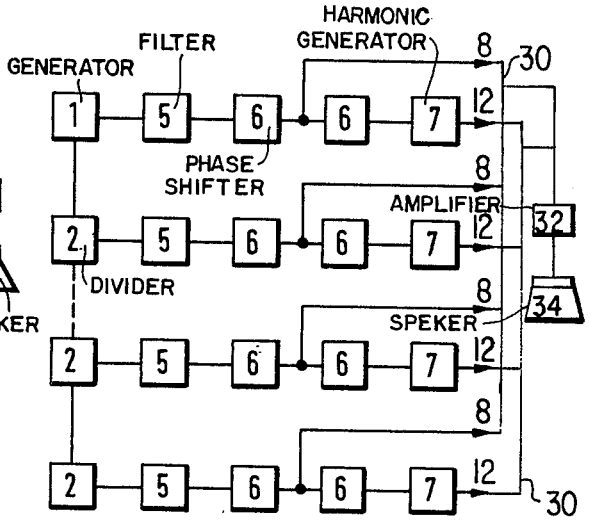

Referring to FIG. 6, this embodiment differs from FIG. 3 since the sound frequency occurring at output 12 is subjected to a multiple (twofold) phase modulation 6, 6 so that a correspondingly large number of modulation products are obtained.

The above embodiments of the invention, given by way of example, can be modified in many ways and may also be combined. In the embodiments of FIGS. 1–6, the signals appearing in the tone leads are passed by way of keys (not shown) to collecting lines 30. Amplifiers 32 and speakers 34 are provided for converting the signals to audible notes.

Figure 8:
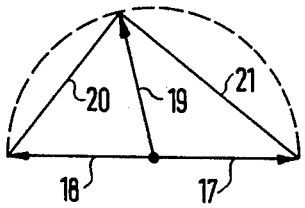
FIG. 8 shows a circle diagram showing voltage vectors obtained from the phase shift apparatus of FIG. 7.

FIG. 7 illustrates the main circuit of an apparatus which effects a straightforward phase modulation (phase shift) without fluctuations in amplitude. Also, shown in the circuit diagram are the reference numerals applied to the voltage vectors as illustrated in FIG. 8. It is well known that in a bipole which consists of a resistor and a capacitance or inductance connected thereto in series, voltage vectors 20 and 21 are always at right-angles to each other. If the terminal voltage at the bipole is of sufficiently low ohmic resistance, voltage vector 19 from the half terminal voltage to the point of connection of R and C or R and L will always have the same value, whereas its phase depends upon the ratio of the real resistance of R to the apparent resistance of C or L. This is equivalent to Thales' geometrical law. This resistance ratio is varied in the same way as the voltage or current of a very low frequency generator (e.g. 0.1 to 0.3 cycles per second). If, the terminal voltage is of sufficiently low ohmic resistance, it suffices merely to vary one element of the bipole. As shown in FIG. 7, the apparatus comprises, for the purpose of phase-modulation, a phase-reversing stage 13 at the output of which are tapped off two low ohmic resistance voltages 17 and 18 of the input frequency and of opposite phase. These voltages are combined by way of condenser 14 and variable resistor 15. The variable resistor 15 alters in value in accordance with the output voltage of a generator 16, which provides a very low frequency. The conversion of the voltage value into a resistance value can be achieved in many ways, an advantageous one involving the use of a periodically illuminated photo-resistor.

Whereas in the apparatus of FIG. 7 care is taken to prevent any change in the amplitude and the harmonic spectrum from occurring during the phase shift, in the apparatus illustrated schematically in FIG. 9 the phase shift is first achieved in known manner by means of RC-elements. The resistor or resistors are transistors 23 the input resistance of which is varied by altering the current that passes through them. Capacitors 22 are connected between the collector of one transistor and the base of the next, thus forming a cascade of phase shift circuits. The current passing through the transistors 23 is controlled by a low frequency generator 24 thereby controlling the modulating cycle of the said phase shifting circuit. It is well known that with a phase shift of this kind there occur in the conventional sense not only changes in amplitude in dependence upon the phase shift, but also changes in the relationship between the basic oscillation and the harmonics and between one harmonic and another. In other words, the amplitude modulation present at switching point 25 and the periodic change in tone color would be audible. Therefore, the signal is regenerated in a subsequent regenerating stage 26 (e.g. a Schmitt trigger) in such manner that the output signal, although corresponding in frequency and phase to the input signal, does not however correspond to it in tonecolor and amplitude. Since the variable resistors are earthed at one side, no optical-electric couplings are necessary. In the embodiments of FIG. 2 and FIG. 4, the divider stages can also effect the subsequent conversion of the signal if these stages have only two switching conditions (e.g. if they are flip-flops).

Features Common To The Apparatus Of FIG. 7 and FIG. 9

As described above, the cyclic phase shift in the apparatus of FIG. 7 and FIG. 9 takes place in dependence upon the voltage or current of a very low frequency generator. If each apparatus is now divided into a generator part and a modulation part, it will be immediately seen that the technical complications involved in the modulator part are relatively small compared with those involved in the generator part. If it is borne in mind that the semi-tone step in the tempered scale, i.e. $\sqrt[12]{2}$, the twelfth root of 2, is an irrational factor in the mathematical sense, then modulation products which result from modulations using one and the same cyclic modulation frequency at different semitones of the tempered scale must also stand in an irrational frequency relationship to each other; i.e. they are individual voices. However, even within the individual octaves of a semitone, many modulation products which result from modulations using one and the same cyclic modulation frequency are irrationally related to each other. The following is an example of this:

In the simplest form a signal frequency F phase-modulated by the frequency $f$, results in the following modulation products (according to value):

$$F \pm (f+2f+3f+4f \ldots .) \qquad \text{Expression F}$$

If the same operation is carried out in the case of the octave tone 2F then in a similar manner there is obtained:

$$2F \pm (f+2f+3f+4f \ldots .) \qquad \text{Expression 2F}$$

Moving a further octave higher there is obtained:

$$4F \pm (f+2f+3f+4f \ldots .) \qquad \text{Expression 4F}$$

If the expressions F and 2F are now considered, it will be seen that a whole-number (rational) relationship exists only between the products $2F \pm 2f$ and the products $F \pm f$, and the products $2F \pm 4f$ and the products $F \pm 2f$. If however the expression F is compared with the expression 4F, then, of the modulation products mentioned, only the expressions $4F \pm 4f$ stand in rational relationship with the expressions $F \pm f$. This means that many modulator parts of the apparatus of FIG. 7 and/or of FIG. 9 can be controlled by a few generators 16 and 24 without the fullness of tone thus suffering. If the variable resistors are constituted by differently illuminated photo-resistors, these can also be mechanically controlled such as by a constant light source with a periodically changing shutter.

Whereas the apparatus of FIG. 7 and of FIG. 9 are preferably used for the cyclic shifting of the phases of individual tones, the apparatus of FIGS. 10 and 11 are eminently suitable for shifting the phase and/or frequency of finished sound patterns in their electric form; these apparatuses can therefore also be used for increasing the fullness of tone in electronic systems used in the entertainment industry. It might again be brought to mind that in the case of an instrument having a sound range of 8 octaves, the ratio of the frequency of the lowest note to that of the highest note is 256. For this reason, a phase shift in proportion to frequency, or a frequency shift would lead to an unclear sound pattern. The following is therefore required of the apparatus of FIG. 10 and of FIG. 11:

1. The change in the sound pattern in accordance with frequency should take place in a manner that is neither independent of nor proportional to frequency.
2. No amplitude modulation should occur.
3. If a frequency shift is intended, a true gain or loss of information should be effected by the apparatus.
4. The dependence of the phase shifts and/or of the frequency shifts should not be defined solely by a monotonic function, but a statistical element should also be added for the purpose of further stimulating the sound pattern.
5. The phase differences occurring at each of the junctions as a result of the gain or loss of information must be continuously evened out so as to prevent sudden shifts in phase from occurring.

This is possible if that portion of the signal that is to be altered is subjected cyclically to differing phase shifts, and its output phase is continuously matched to its input phase at the end of each cycle. The electric signal which is generally a mixture of frequencies is thus passed along a chain of electric phase-shift elements the individual shift of which, while dependent upon the particular frequencies, is, however, expediently not proportional to them. The cyclically repeated passage of signals through the chain of phase-shift elements is virtually kept in one direction in the case where substantially only a frequency shift is intended. Return takes place, again cyclically, by continuously matching the signal phases at the output point to those at the input point of the chain of phase-shift elements upon simultaneous recommencement of the passage of the signal.

In the case of the apparatus shown in FIG. 10, a chain of fixed phase-shift elements $P_1$, $P_2$ and so on, the outputs of which are successively scanned in a cyclically repeated manner, is provided for shifting the phase of a portion $S_E$ of the signal of which the frequency is to be varied. The individual phases of the signal frequencies are here switched from the outputs of the individual phase shift elements to the signal output in a continuous manner by means of a chain of counting impulses in the same cycle.

If a signal passes through the chain of phase-shift elements, a phase shift that is dependent upon frequency is achieved in each element. The counting chain Zl to Zn in FIG. 10 is able to alter the resistance RVl . . . RVn which are variable in time in different well-known ways, for example opto-electronically or according to the modulator principle, which will be well-known to an electronics technician. Because of the continuous impulses from the elements of the counting chain $Z_l$ to $Z_n$ and from $Z_n$ direct to $Z_l$, the signals occurring at each of the impulse times at the phase-shift elements $P_1$, $P_2$ etc. are passed to the signal output $S_A$ through the resistors $R_{t2}$, $R_{t2}$ etc. in dependence on the signals from the counting chain. The end phase of a signal switched to the output point $S_A$ through the last resistor will differ from the signal phase passed through the first resistor by a maximum of 180°, and in the statistical mean by 0°, irrespective of the number of shifts undergone by the signal in the chain $P_1$, $P_2$ etc. In the case of a phase lag, a loss in information occurs, and in the case of a phase lead, a gain in information is achieved which contains a statistical element in each case because of the matching, differing by a maximum of 180°, of the end phase to the initial phase. The maximum phase difference of 180° between SE and SA is apparent from the fact that, within a circle of 360° representing the closed loop counting chain $Z_1$–$Z_n$, two points located on the circle cannot be more than 180° apart.

FIG. 11 illustrates an apparatus in which, in contrast to the apparatus of FIG. 10, there is provided a chain of cyclically varying phase-shift elements $P_1$, $P_2$ etc., through which passes the portion $S_E$ of the signal that is to be varied. The phase shifters Pl . . . Pn are varied by the use of a saw-tooth type voltage represented in FIG. 11 as a function of the time *t* with respect to their phase rotation and are all varied in common. Here, as shown in the diagram, at the end of each phase shift period the output SA is short circuited with the input SE, as illustrated by the lower curve of FIG. 11 which shows the current $i_L$ passing through line L. At this instant the phase shift imposed on the signal returns to zero. The variation of the resistance Rvv in the line L between SA and SE can likewise be carried out in a well-known manner, e.g., opto-electronically or in accordance with the modulator principle. The application of the control signals to the phase shifters take place for instance according to the circuit of FIG. 7, in which case an apparatus as illustrated in FIG. 7 may be used as each variable phase-shift element. In the case of the apparatus of FIGS. 10 and 11 there is a further possibility of initiating a cycle additionally or exclusively by striking the keys.

In musical instruments which operate in accordance with the above-described methods for the purpose of increasing the fullness of tone, the individual notes in the registers are generally obtained from a synchronous set of notes usually available only once. Since at least this set of notes must operate when a key is depressed, special problems arise as regard the keys in an instrument of this kind, such as the need for considerable cross-talk damping as well as for an acoustically correct transient oscillation of individual tones. According to an embodiment of the invention, this is achieved by means of a double key system whereby twelve master generators or the outputs of the synchronous set of notes and the note signals (tones of the register) are actuated. A key arrangement of this kind is particularly advantageous if it operates continuously and by means of a servo-control circuit, since then on the one hand all registers are separately available at the output and on the other hand, the player is able to produce the required intonation (legato, staccato etc.).

I claim:

1. An electronic musical instrument having an increased fullness of tone, said instrument comprising:

a. a signal generator for generating a first audio frequency signal corresponding to a single note of the musical scale, said first signal appearing on a first lead;

b. a plurality of serially connected harmonic generators, the first of which receives said first audio frequency signal from said signal generator and each subsequent harmonic generator receiving a new harmonic of the first audio frequency signal from the preceding harmonic generator, each harmonic generator of the series supplying on a respective tone lead an audio frequency signal constituting a new harmonic of said first audio frequency signal and corresponding to a single note of the musical scale;

c. a phase shifter connected to said first lead and a separate phase shifter connected in each said harmonic generator tone lead for subjecting the signal on the lead in which the phase shifter is connected to a cyclic phase shift which is different than the phase shift to which the other of said signals are subjected;

d. means for controlling the period of cycle of each said cyclic phase shifter so the phase shift is not audibly perceptible in the respective individual note; and e. output means for electrically interconnecting the phase-shifted signals from said phase shifters and converting said signals into audible sound, whereby to the ear of a listener the sound has the character of notes emanating from a plurality of distinct voices.

2. An instrument according to claim 1, wherein each said phase-shifter comprises a modulator with a phase-reversing stage which converts the signal on the lead in which the phase shifter is connected into two voltages of like frequency and amplitude but of opposite phase, and further comprises a network adapted to be fed with the two said voltages, said network including a fixed and a variable element and means for tapping the phase-shifter output signal from a point between the fixed and the variable element.

3. An instrument according to claim 2, wherein said controlling means comprises a generator of which the low frequency output can vary to control the change in the variable element.

4. An instrument according to claim 1, wherein said phase shifting means comprises at least one periodically variable resistance-capacitance element and a subsequent means to convert said signal into a signal of constant amplitude and harmonic spectrum, but in dependence upon the frequency and phase of the fundamental frequency of said signal at an input point of said subsequent stage.

5. An instrument according to claim 4, wherein the periodically variable resistor of said resistance-capacitance element is constituted by the variable input resistance of a transistor and wherein the current passing through said transistor is controlled by said controlling means.

6. An instrument according to claim 1, wherein said phase-shifters are controlled by a common controlling means.

7. An instrument according to claim 1, wherein the period of cycle of said phase shift is from 0.1 to 0.3 cycles per second.

8. An instrument according to claim 1, wherein each said cyclic shifter comprises a serial chain of fixed phase shift elements, each element adding a phase shift to the signal passing through said chain and means for successively scanning the output points of said elements in a cyclically repeated manner and passing the scanned signal to the phase shifter output whereby the phase difference between the signal appearing at the phase shifter input and the signal appearing at the phase shifter output varies with time.

9. An instrument according to claim 1, wherein each said phase shifter comprises a serial chain of cyclically changing phase shift elements, each element adding a phase shift to the signal passing through said chain, and means for periodically causing the phase difference between the output signal of the phase-shifter and the input signal to the phase-shifter to be momentarily reduced to zero.

10. An electronic musical instrument having an increased fullness of tone, said instrument comprising:

a. a signal generator for generating a first audio frequency signal corresponding to a single note of the musical scale;

b. a plurality of harmonic generators and a corresponding plurality of phase shifters connected in an alternating serial arrangement wherein the input of each said harmonic generator is connected to the output of a respective phase shifter, the output of each said harmonic generator except the last in the series connected to the input of a respective phase shifter, and the input of the first said phase-shifter is connected for receiving said first audio signal, the output of each said harmonic generator comprising an audio frequency signal which constitutes a new harmonic of said first audio frequency signal and corresponds to a single note of the musical scale;

c. means for controlling the period of cycle of each said cyclic phase shifter so the phase shift is not audibly perceptible in the respective individual note and so the output of each harmonic generator is asynchronous with the outputs of other of said harmonic generators; and d. output means for electrically interconnecting the signals from said harmonic generators and converting said signals into audible sound, whereby to the ear of a listener the sound has the character of notes emanating from a plurality of distinct voices.

11. An instrument according to claim 10, wherein each said phase-shifter comprises a modulator with a phase-reversing stage which converts the signal on the lead in which the phase shifter is connected into two voltages of like frequency and amplitude but of opposite phase, and further comprises a network adapted to be fed with the two said voltages, said network including a fixed and a variable element and means for tapping the phase-shifter output signal from a point between the fixed and the variable element.

12. An instrument according to claim 11, wherein said controlling means comprises a generator of which the low frequency output can vary to control the change in the variable element.

13. An instrument according to claim 10, wherein said phase shifting means comprises at least one periodically variable resistance-capacitance element and a subsequent means to convert said signal into a signal of constant amplitude and harmonic spectrum, but in dependence upon the frequency and phase of the fundamental frequency of said signal at an input point of said subsequent stage.

14. An instrument according to claim 13, wherein the periodically variable resistor of said resistance-capacitance element is constituted by the variable input resistance of a transistor and wherein the current passing through said transistor is controlled by said controlling means.

15. An instrument according to claim 10, wherein said phase-shifters are controlled by a common controlling means.

16. An instrument according to claim 10, wherein the period of cycle of said phase shift is from 0.1 to 0.3 cycles per second.

17. An instrument according to claim 10, wherein each said cyclic shifter comprises a serial chain of fixed phase shift elements, each element adding a phase shift to the signal passing through said chain and means for successively scanning the output points of said elements in a cyclically repeated manner and passing the scanned signal to the phase shifter output whereby the phase difference between the signal appearing at the phase shifter input and the signal appearing at the phase shifter output varies with time.

18. An instrument according to claim 10, wherein each said phase shifter comprises a serial chain of cyclically changing phase shift elements, each element adding a phase shift to the signal passing through said chain, and means for periodically causing the phase difference between the output signal of the phase-shifter and the input signal to the phase-shifter to be momentarily reduced to zero.

19. An electronic musical instrument having an increased fullness of tone, said instrument comprising:

a. means for producing at least one set of individual synchronous sound oscillations;

b. means for subjecting individual sound oscillations of said set to a different cyclic phase shift to other individual sound oscillations thereof;

c. means for controlling the period of cycle of each phase shift so that the phase shift is not audibly perceptible in the respective individual sound oscillation; and d. output means for electrically interconnecting and converting into audible sound the phase-shifted individual sound oscillations, wherein said phase-shifted individual sound oscillations, wherein said phase-shifting means comprises at least one periodically variable resistance-capitance element and a subsequent means to convert the individual sound oscillation into an oscillation of constant amplitude and wave shape independently of amplitude and harmonic spectrum, but in dependence upon the frequency and phase of the fundamental frequency at an input point of said subsequent means.

20. An electronic musical instrument having an increased fullness of tone, said instrument comprising:

a. means for producing at least one set of individual synchronous sound oscillations;

b. means for subjecting individual sound oscillations of said set to a different cyclic phase shift to other individual sound oscillations thereof;

c. means for controlling the period of cycle of each phase shift so that the phase shift is not audibly perceptible in the respective individual sound oscillation; and d. single output means for electrically interconnecting each of the phase-shifted individual sound oscillations with a sound oscillation of the same fundamental frequency which has not been subjected to the same phase shift, thereby producing audible beats, wherein said phase-shifting means comprises at least one periodically variable resistance-capacitance element and a subsequent means to convert the individual sound oscillation into an oscillation of constant amplitude and wave shape independent of amplitude and harmonic spectrum, but in dependence upon the frequency and phase of the fundamental frequency at an input point of said subsequent means.

* * * * *